US009629436B2

(12) United States Patent
Horvath et al.

(10) Patent No.: US 9,629,436 B2
(45) Date of Patent: Apr. 25, 2017

(54) FOIL ROLL FOR USE WITH PAD FOR REMOVING NAIL GEL AND ACRYLIC NAILS AND METHOD FOR MANUFACTURING

(75) Inventors: Gavril Horvath, Tarzana, CA (US); George Schaeffer, North Hollywood, CA (US)

(73) Assignee: O P I PRODUCTS, INC., North Hollywood, CA (US)

( * ) Notice: Subject to any disclaimer, the term of this patent is extended or adjusted under 35 U.S.C. 154(b) by 0 days.

(21) Appl. No.: 13/247,933

(22) Filed: Sep. 28, 2011

(65) Prior Publication Data

US 2013/0074859 A1 Mar. 28, 2013

(51) Int. Cl.
*A45D 29/18* (2006.01)
*A45D 29/00* (2006.01)

(52) U.S. Cl.
CPC .... *A45D 29/007* (2013.01); *A45D 2200/1018* (2013.01); *A45D 2200/1036* (2013.01); *Y10T 83/02* (2015.04)

(58) Field of Classification Search
CPC .... A45D 29/00; A45D 29/001; A45D 29/004; A45D 29/007; A45D 2029/002; A45D 2029/008; A45D 29/22; A45D 29/27; A45D 2200/1018; B65D 83/00; A61F 13/00; A61F 2013/00646; A61F 2013/00655; A61F 5/002
USPC ..... 132/74.5, 73, 200, 285, 320, 319
See application file for complete search history.

(56) References Cited

U.S. PATENT DOCUMENTS 2,431,203 A * 11/1947 Sebastian ..... A61F 13/105 602/42
3,124,825 A * 3/1964 Iovenko ..... A45D 29/007 134/6
3,598,685 A * 8/1971 Lee et al. ..... 132/73
3,921,802 A * 11/1975 Thompson ..... A47K 10/42 206/225
4,637,411 A * 1/1987 Sanders ..... A45D 19/0025 132/212
4,800,904 A * 1/1989 Kinseley et al. ..... 132/73.5
4,860,736 A * 8/1989 Kaitz ..... A61F 13/105 132/73
5,320,217 A * 6/1994 Lenarz ..... A45D 29/007 206/209
6,016,915 A * 1/2000 Almond ..... 206/570
(Continued)

OTHER PUBLICATIONS

*Magis Foil Nail Warps,* Products Page http://www.foilnailwraps.com/products, Sep. 27, 2011, pp. 1-2.

*Primary Examiner* — Robyn Doan
(74) *Attorney, Agent, or Firm* — Blakely Sololoff Taylor & Zafman LLP

(57) ABSTRACT

A nail gel/acrylic removal system and method for manufacturing a roll of foil segments with pads around a core used for nail gel and acrylic nail removal. A pad is configured to receive and absorb a substance for dissolving at least one of nail gel and acrylic nails. A segment of foil with an affixed pad is sized to wrap around at least a portion of a finger of a human hand so that the pad with the substance for dissolving is in contact with a fingernail of the hand. First and second sets of perforations are placed along opposite edges of the foil segment, so that pairs of foil segments with the pads are joined at the first and second set of perforations. A roll is formed of the foil segments with pads around a core.

4 Claims, 3 Drawing Sheets

(56) References Cited

U.S. PATENT DOCUMENTS

| | | | | |
|---|---|---|---|---|
| 6,367,485 | B1 * | 4/2002 | Dutton-Davis | A45D 29/007 132/200 |
| 6,722,375 | B1 * | 4/2004 | Falls | A45D 2/18 132/207 |
| 9,055,801 | B1 * | 6/2015 | Schuch | A45D 29/007 |
| 2005/0194415 | A1 * | 9/2005 | Danechi | B65H 16/028 225/96 |
| 2010/0038374 | A1 * | 2/2010 | Campi | A61F 13/02 221/46 |
| 2010/0175942 | A1 * | 7/2010 | Griep et al. | 180/90.6 |
| 2010/0305491 | A1 * | 12/2010 | Baschnagel | A61F 13/38 602/48 |

* cited by examiner

FOIL ROLL FOR USE WITH PAD FOR REMOVING NAIL GEL AND ACRYLIC NAILS AND METHOD FOR MANUFACTURING

FIELD OF THE INVENTION

The invention is directed to systems and methods for removing nail gel and acrylic nails or the like from fingernails and toenails.

BACKGROUND OF THE INVENTION

It is well known in the art to use a cotton pad or other absorbent material which is soaked in acetone or similar product to remove nail gel or acrylic nails applied to a person's fingernails or toenails for decorative purposes. Typically, the pad with acetone or similar material is applied to a fingernail with nail gel or acrylic nail and the pad is allowed to soak for a period of time on the nail and/or the pad is moved up and down/back and forth across the nail to remove the gel or acrylic nail. Since it is sometimes necessary for the pad to be in contact with the nail for a period of time in order to remove the gel or acrylic nail, it is known to apply the pad to the nail, and then wrap the pad and fingertip with a small piece of aluminum foil to hold the pad in place for a period of time. In this manner, it is possible to substantially simultaneously remove the gel or acrylic nails from the nails of all ten fingers and/or all ten toes.

In a further improvement, individual sheets of foil are pre-cut with an absorbent pad attached to the foil with each sheet/pad combination stacked on top of one another. Although more convenient than using an absorbent pad alone, or an absorbent pad with a subsequently added foil wrapping on the tip of the finger, since each foil sheet is relatively thin, in a nail salon environment where it is desirable to minimize waste and improve efficiency, due to the thinness of the foil, it can be difficult to pick up one foil sheet/pad combination at a time. That is, when a sheet of foil is selected, if not enough pressure is applied, the attempt to grab the sheet will result in no sheet being grabbed, or if too much pressure is applied, multiple sheets will be picked up when only one sheet was desired.

SUMMARY OF THE INVENTION

The invention is directed to sheets of foil with integrated pads for use to remove nail gel or acrylic nails. The sheets are formed on a roll with perforations separating each sheet so that at the time of use, one sheet at a time can be torn along the perforation to separate the sheet from the roll. In one embodiment, there are small cuts at the edge of each perforation so that it is easier to tear a single sheet/pad combination at a time.

DETAILED DESCRIPTION OF THE INVENTION

Figure 1:
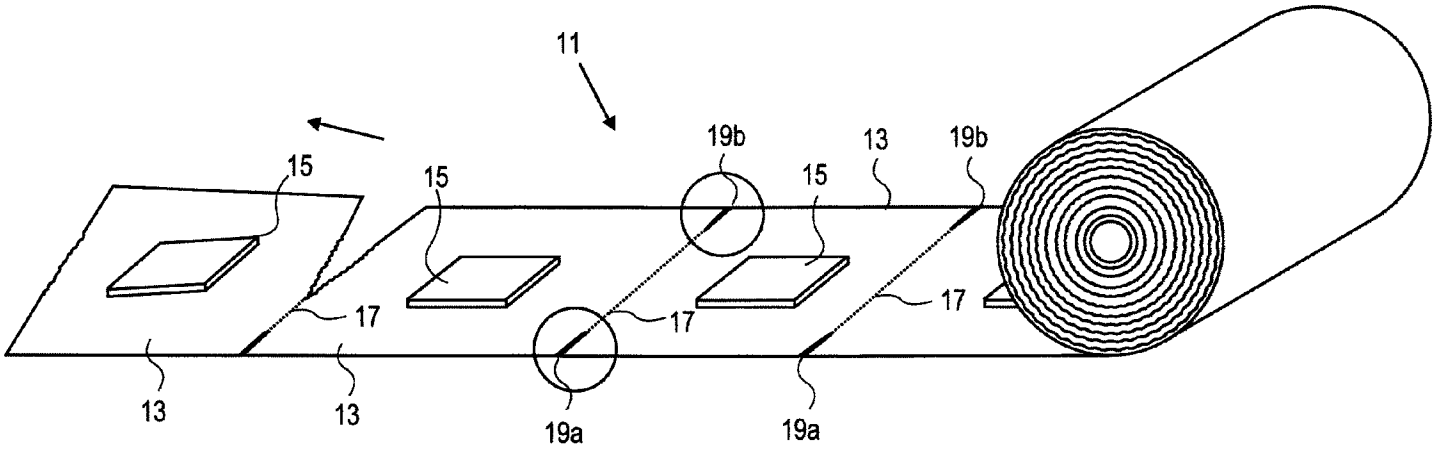
FIG. 1 is schematic view of a foil roll with pad, perforations and cuts according to the invention.
Figure 2:
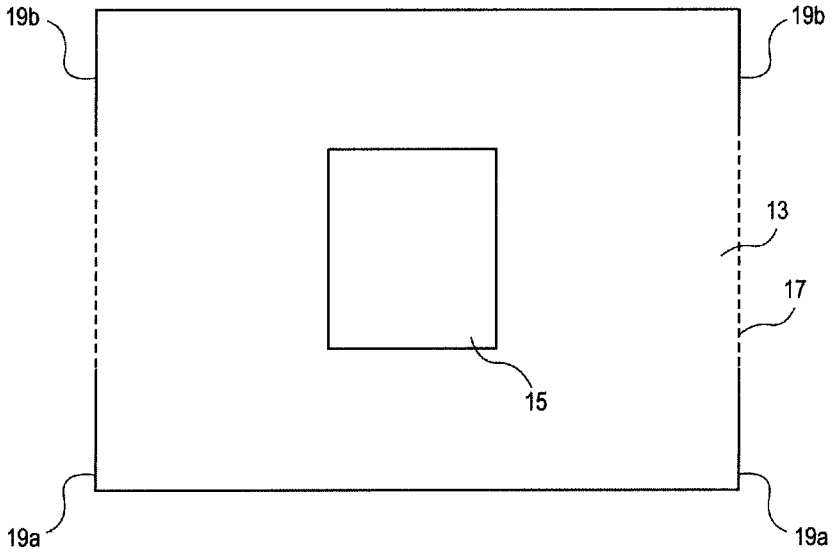
FIG. 2 is a detailed view of a single sheet of the foil roll.

FIG. 1 shows a roll of foil 11 with integrated pads. Individual foil sheets 13 are formed on the roll, each sheet having an integrated pad 15. Each sheet is separated from its adjacent sheet by perforations 17. In one embodiment, at the end of each set of perforations 17, are cuts 19*a* and 19*b* which extend from the perforations to the edge of the sheet. Alternatively, perforations 17 may extend the entire length of the edges of each sheet.

By adding cuts 19*a* and 19*b* at the end of each row of perforations, when the sheet is pulled from either direction, the cut will start the sheet separating from its adjacent sheet along the perforation.

A suitable size for a sheet 13 of foil for the purpose as set forth herein is about 2.9 inches ×3.8 inches. Centered on the sheet is pad 15 with a suitable size for the purpose as set forth herein of about 1 inch×1.2 inches. In one embodiment, the pad is a rayon polyester blend, but any absorbent material may be used. Of course, the precise dimensions are not important as any suitable size wherein the pad substantially covers the nail and the foil can wrap around the fingertip or toes so that the pad is held in place can be used. The pad is affixed to the foil using any suitable adhesive which is not dissolved by acetone or other solution use to remove the nail gel or acrylic nails. For example, an acrylate resin can be used by applying the resin with an initiator on the aluminum foil). The pad is then placed on this resin and the resin/pad combination is cured under heat or UV light to cure the resin.

The foil has a standard thickness such as ½ mil (0.0005 inch). The perforations should be centered along the edges which arc parallel to an axis around which the foil is rolled. In a preferred embodiment, the perforations 17 are spaced so there are six cuts through the foil per inch with each cut leasing 0.0038 inch of foil between each cut. If present, cuts 19*a* and 19*b* extend from the edge of each sheet. A suitable tool can be used to create the perforations and cuts simultaneously. The specifics of the design of such a tool are well known in the art. The characteristics of such a tool are that it preferably be made out of a solid tool steel which is able to hold to tighter tolerance than most other materials.

Typically, a length of foil is created according to well known prior art techniques. The foil is then processed according to the following steps.

Figure 3:
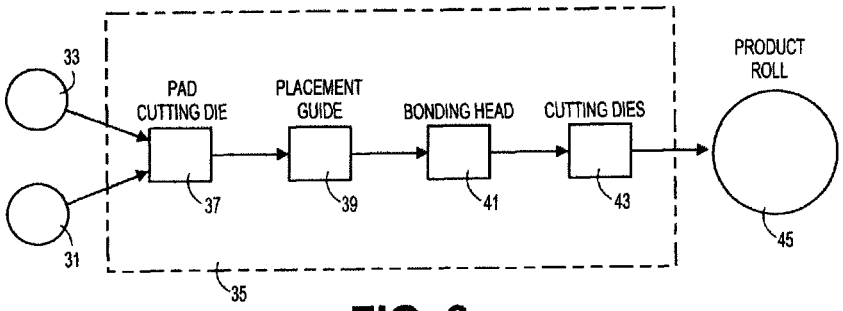
FIG. 3 is a block diagram showing how a foil roll with integrated pads is made.

Referring to FIG. 3, a blank foil roll 31 and a roll of the pad material 33 are input to an apparatus sometimes referred to as a narrow web press 35 having four stations such as a Delta Mod-Tech, model CRU/G&L-13 available from Delta Industrial Services. Inc. located in Minneapolis, Minn. The first station referred to as a pad cutting die 37 brings together the foil and pad materials from rolls 31 and 33 respectively which travel in line through the pad cutting die and run through guides which align the two materials for further processing.

The second station referred to as a placement guide die cuts the pad material into the desired pad size for placement on the foil at the bonding head station 41. At bonding head station 41, the cut pad is bonded to the foil. A sensor controls an acceleration roller to ensure proper spacing of the pad material on the foil by controlling the speed at which the roll of pad material and the foil roll are processed through the apparatus. At the next station, which contains cutting dies 43, the perforations are applied to the foil using a cutting tool as described above. The foil with the perforations and bonded pad is then rewound onto product roll 45. The width of the foil and pad materials may, for example, be double the width of the end use product in which case cutting dies 43 also slit the roll along its length so as to create two separate rolls of finished product.

Figure 4:
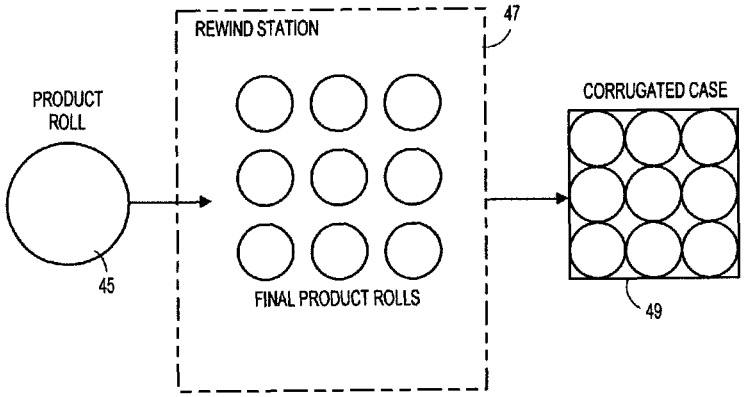
FIG. 4 is a block diagram showing how a completed foil roll with integrated pad is formed into finished product rolls.

Although not necessarily part of the invention, for completeness, reference is made to FIG. 4, which shows product roll 45 being input into rewind station 47 where the product roll is rewound onto a final product roll for packaging into a corrugated case 49 for shipment. In a preferred embodiment rewind station 47 includes a sensor to indicate if a pad is missing, and a counter system that ensures that the correct number of pad foil combinations are on each roll, typically 250.

Once the pads, slits and perforations have been added, the sheets are rolled onto a core to form a final product roll. In one embodiment, a roll includes 250sheets of foil with an attached pad. Of course, the precise number of sheets which are used to form a roll do not form a part of the invention which is limited only as set forth in the following claims.

We claim:

1. A method for making a foil and pad roll used for removal of nail gel and acrylic nails comprising:

a) configuring a pad to receive and absorb a substance for dissolving at least one of nail gel and acrylic nails;

b) sizing a single segment of foil without a backing to wrap completely around a fingertip of a human hand so as to maintain contact between said pad and said nail gel or acrylic nail on said fingertip;

c) affixing said pad to said foil segment with an acrylate resin applied with an initiator on the foil segment;

d) curing the resin/pad combination cured under heat or UV light to cure the resin;

e) disposing a first set of perforations along an inner portion of a first edge of said foil segment;

f) disposing a second set of perforations along an inner portion of a second edge of said foil segment, wherein said first edge and said second edge are at opposite ends of said foil segment;

g) providing a first and a second cut extending from a perimeter of said foil segment to ends of said first set of perforations, wherein said first cut and said second cut are co-linear with said first set of perforations;

h) providing a third and a fourth cut extending from a perimeter of said foil segment to ends of said second set of perforations, wherein said third cut and said fourth cut are co-linear with said second set of perforations;

i) forming a roll of said foil segments with said first and second set of perforations around a core wherein said foil segments each have one said pad affixed thereto.

2. The method of claim 1 wherein said pad is substantially centered on its corresponding foil segment.

3. The method of claim 1 wherein said first set and second set of perforations are substantially centered along said first edge and said second edge, respectively.

4. The method of claim 1 wherein said foil has a thickness of approximately ½ mil and said perforations of said first set and said second set are spaced at intervals leaving 0.0038 inch of foil between each cut.

* * * * *